US008083602B2

(12) United States Patent
Contestabile

(10) Patent No.: US 8,083,602 B2
(45) Date of Patent: Dec. 27, 2011

(54) CUE STICK TIP TOOL

(76) Inventor: Kevin D Contestabile, Rochester, NY (US)

( * ) Notice: Subject to any disclaimer, the term of this patent is extended or adjusted under 35 U.S.C. 154(b) by 128 days.

(21) Appl. No.: 12/234,873

(22) Filed: Sep. 22, 2008

(65) Prior Publication Data

US 2010/0075769 A1 Mar. 25, 2010

(51) Int. Cl.
*A63D 15/16* (2006.01)
*A63D 15/00* (2006.01)

(52) U.S. Cl. ..... 473/36; 473/1; 473/35; 30/494

(58) Field of Classification Search ..... 473/35, 473/36, 37; 30/494, 374; D8/90; D21/782; 224/183, 271, 918
See application file for complete search history.

(56) References Cited

U.S. PATENT DOCUMENTS

| | | | | |
|---|---|---|---|---|
| 363,898 | A * | 5/1887 | Labre | 473/36 |
| 955,819 | A | 4/1910 | Mahoney | |
| 1,259,136 | A | 3/1918 | Rogers | |
| 3,963,237 | A | 6/1976 | Bushberger | |
| 3,989,079 | A | 11/1976 | Treadway | |
| 4,785,586 | A | 11/1988 | Kratfel | |
| 4,827,618 | A | 5/1989 | Lynn | |
| 4,953,770 | A | 9/1990 | Bond, Sr. | |
| 5,104,122 | A | 4/1992 | Gossman | |
| 5,129,187 | A | 7/1992 | Cain | |
| 5,228,160 | A * | 7/1993 | Porper | 30/494 |
| 5,545,093 | A | 8/1996 | Contestabile | |
| 5,865,682 | A | 2/1999 | Sutton | |
| 5,887,350 | A * | 3/1999 | Porper | 30/494 |
| 6,341,399 | B2 * | 1/2002 | Method | 473/1 |
| 6,602,143 | B2 * | 8/2003 | Pettigrew | 473/1 |
| 6,905,417 | B1 | 6/2005 | Tona et al. | |
| 7,210,233 | B2 | 5/2007 | Costain | |
| 7,628,706 | B2 * | 12/2009 | Xie | 473/36 |
| 2002/0010031 | A1 | 1/2002 | Pettigrew | |
| 2006/0148582 | A1 | 7/2006 | Brownell | |
| 2008/0113595 | A1 | 5/2008 | Xie | |

FOREIGN PATENT DOCUMENTS

| | | |
|---|---|---|
| WO | WO0067860 | 11/2000 |

* cited by examiner

*Primary Examiner* — Mitra Aryanpour
(74) *Attorney, Agent, or Firm* — Eugene S. Stephens, PC

(57) ABSTRACT

A cue stick tip tool includes a shaper that can contour the tip to a nickel or dime radius by using an abrasive formed within a hollow shaper body. Also included is a ferrule guide surface leading to abrasive material usable to trim a side of the cue tip while holding the ferrule clear of the abrasive material to avoid scuffing the ferrule. Another included tool has a concave cylindrical grid of upstanding pointed spikes that can be rolled over the cue tip to make a pattern of chalk holding indentations in the cue tip. The tool package preferably also includes a conical recess for burnishing a side of the cue tip, arcs to measure nickel and dime radii of the cue tip, and a container holding a chalk block and talcum powder—all arranged to be carried on a belt clip.

15 Claims, 7 Drawing Sheets

CUE STICK TIP TOOL

TECHNICAL FIELD

Multi-purpose tools for shaping and conditioning tips of cue sticks.

BACKGROUND

The many tools that have been suggested for shaping and conditioning the tips of cue sticks all suffer from shortcomings. They do one or two jobs, but fail to do everything that cue stick users desire. For example, they lack satisfactory tools for trimming side edges of cue tips without scuffing the cue tip ferrule. They also lack a quick and effective way of forming indentation holes to better retain chalk on the cue tip. Even when previously suggested tools do some of the operations that are desired, they often fail to work as well as users would prefer. They also need improvement in packaging all the necessary tools compactly in a belt clip holster.

SUMMARY

The invention aims at meeting all the needs that are not fully satisfied by the previously suggested variety of cue tip tools. The invention also aims at accomplishing this in a multi-purpose tool that is high quality, durable, convenient, compact, and also affordably inexpensive.

The invention packages several tool components compactly into a belt clip holder. The components include a side shaper that guides a cue tip into contact with abrasive material so that a side of the tip can be trimmed without risk of scuffing the cue tip ferrule. Another component has a generally cylindrical and concave surface formed with upstanding spikes that can be rolled over the cue tip to indent tiny cavities to hold chalk. Other components of the tool include arcs to measure the curvature of a cue tip, and a conical burnishing surface for burnishing the side of a cue tip. All of these, and some additional components, are packaged compactly into a belt clip holder that includes a chalk block and talcum powder.

DRAWINGS

DETAILED DESCRIPTION

Figure 2:
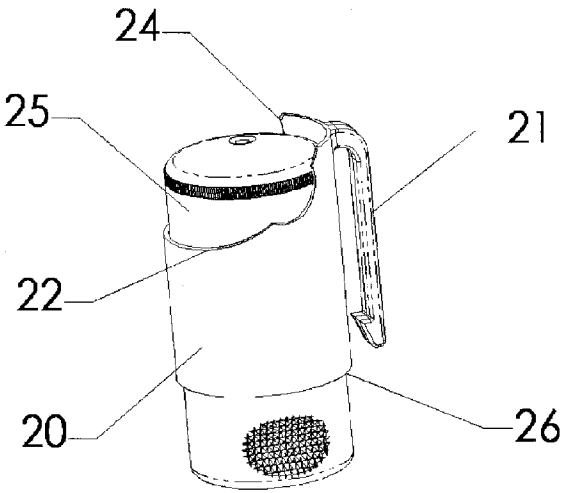
FIG. 2 is a perspective view of the embodiment of FIG. 1.
Figure 3:
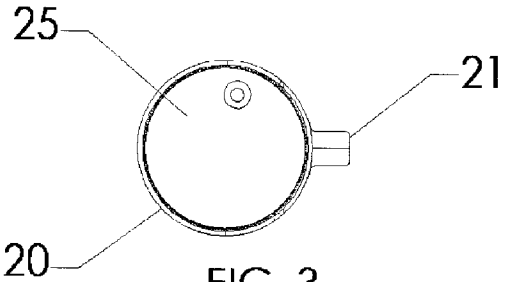
FIG. 3 is an end view of the embodiment of FIG. 1.
Figure 1:
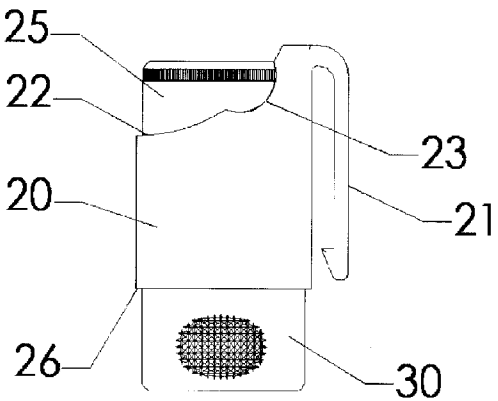
FIG. 1 is a side view of a preferred embodiment of the inventive tool.
Figure 10:
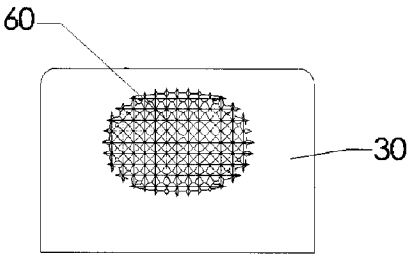
FIG. 10 is a side view of a portion of the shaper visible in FIGS. 5 and 7-9.
Figure 5:
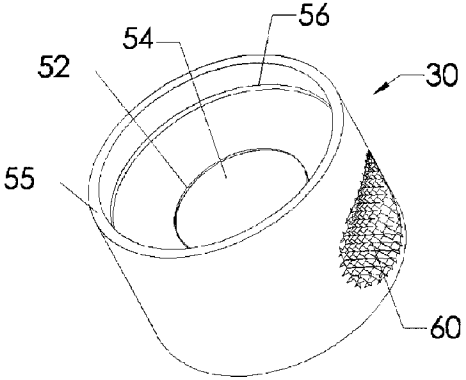
FIG. 5 is a perspective view at a different angle of the shaper of FIG. 4.

The several components of the invention are preferably packaged compactly as shown in FIGS. 1-3. Within a holder 20 having a belt clip 21 is a container 25 for a chalk block and talcum powder. An open end 22 of holder 20 that receives container 25 also preferably includes arcs 23 and 24 having respective nickel and dime radii that are desired for measuring the curvature of cue tips. These gauge arcs 23 and 24 can also be located elsewhere.

At an opposite end 26 of holder 20 is a shaper 30 that is preferably retained on holder 20 by a snap fit connection. Shaper 30 accomplishes several tip processing operations, and shaper 30 is readily available for these purposes, simply by unsnapping it from holder 20.

Figure 8:
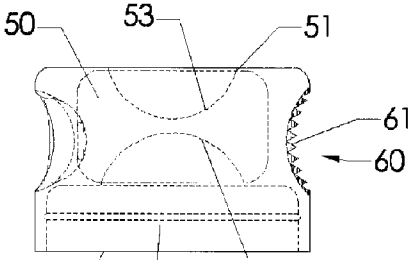
FIGS. 8 and 9 are opposite side views of the shaper of FIG. 7.
Figure 7:
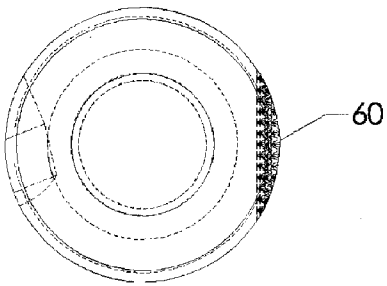
FIG. 7 is an end view of the shaper of FIGS. 4 and 5.
Figure 9:
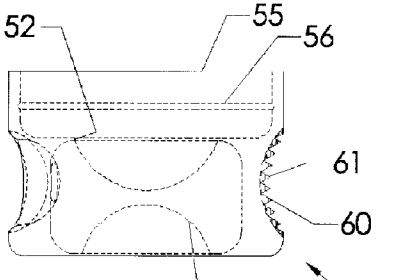
Figure 6:
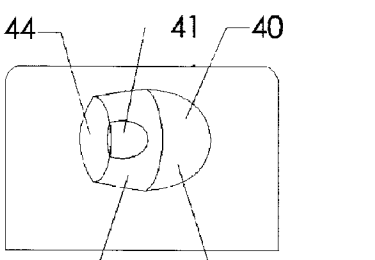
FIG. 6 is a side view of a shaper guide for trimming a side of a cue tip.
Figure 4:
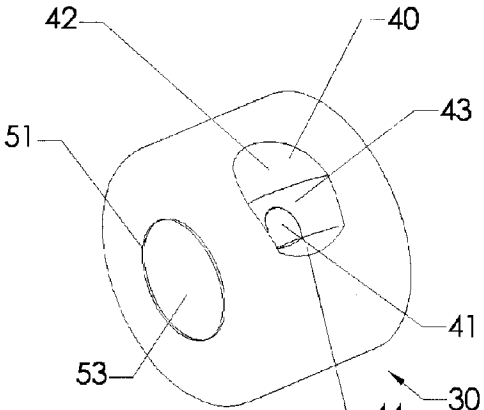
FIG. 4 is a perspective view of a shaper of the tool of FIGS. 1-3.
Figure 12:
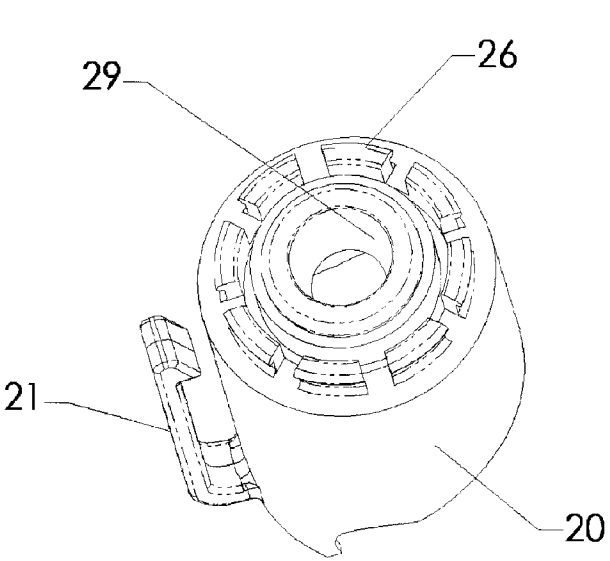
FIGS. 11 and 12 are perspective views of opposite ends of a holder for the shaper of FIGS. 4-10.
Figure 14:
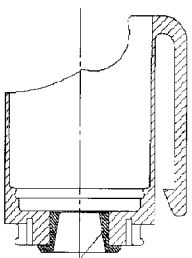
FIG. 14 is a cross-section of the holder of FIG. 13 taken along the line 14-14 thereof.
Figure 13:
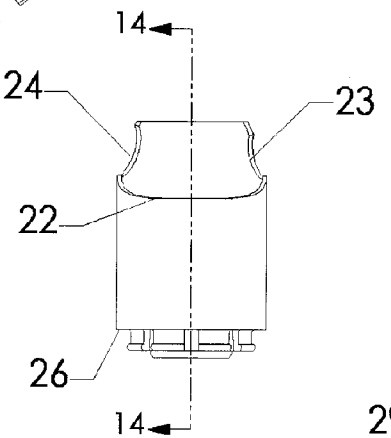
FIG. 13 is a side view of the holder of FIGS. 11 and 12.
Figure 11:
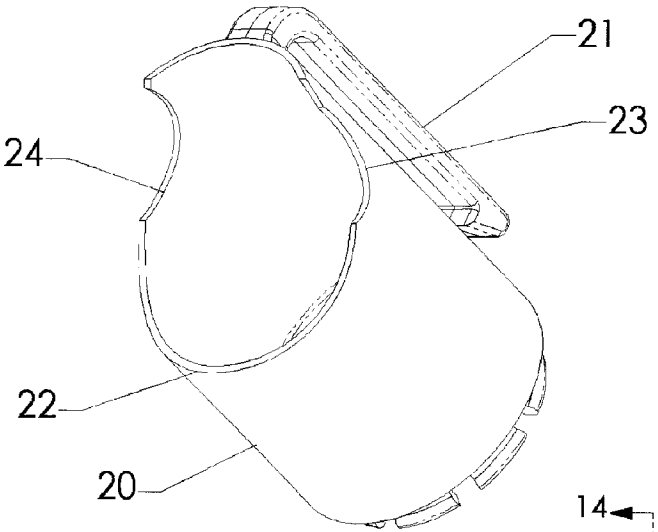

Shaper 30 is preferably a hollow body as best shown in FIGS. 7-9. Phantom lines of these figures show a solid mass of abrasive material 50 formed within shaper 30. Shaper 30 has a pair of axial openings 51 and 52 that allow access to abrasive material 50, which is formed to present a dime radius 53 at shaper opening 51 and a nickel radius 54 at shaper opening 52.

Figure 16:
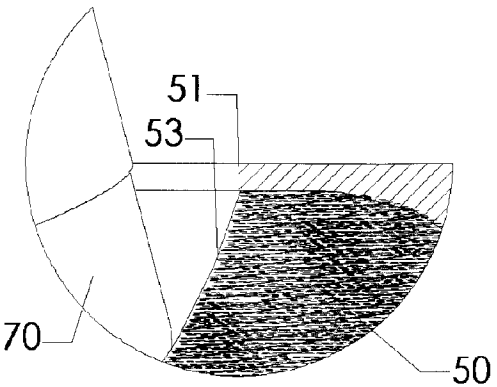
FIG. 16 is an enlarged detail taken from FIG. 15.
Figure 15:
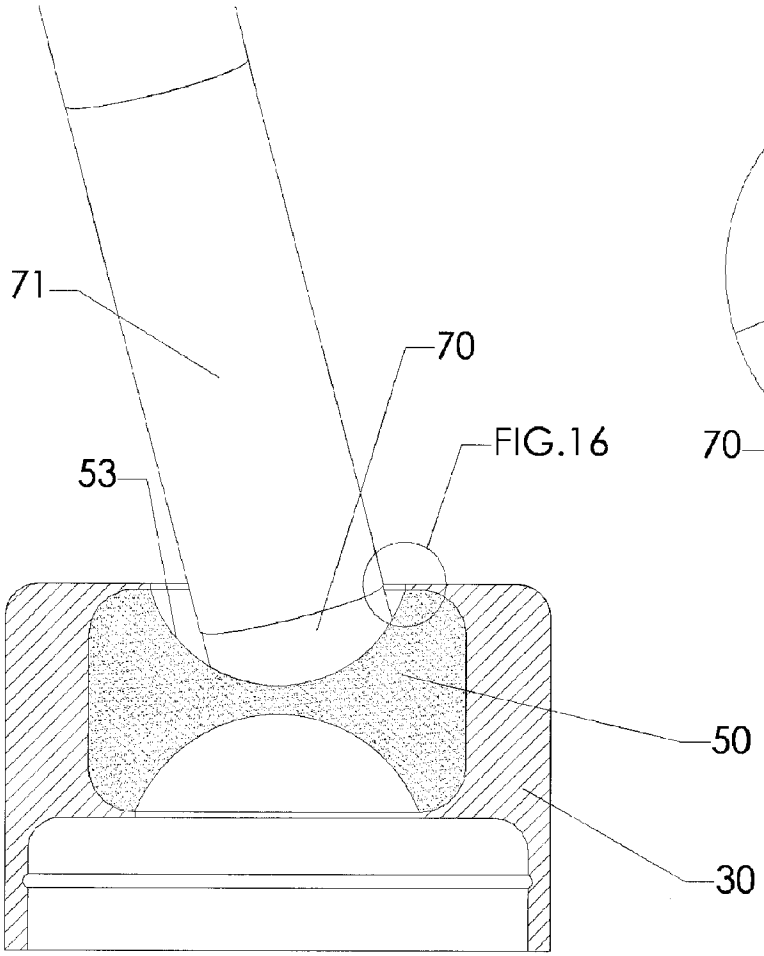
FIG. 15 is a cross-sectional view of the shaper of FIGS. 4-10 being used to shape a cue tip.
Figure 18:
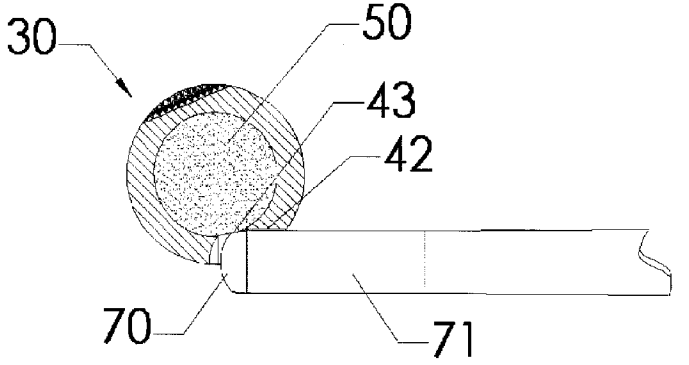
FIG. 18 is a cross section of the shaper of FIG. 17 being used to shape a side of a cue tip.
Figure 17:
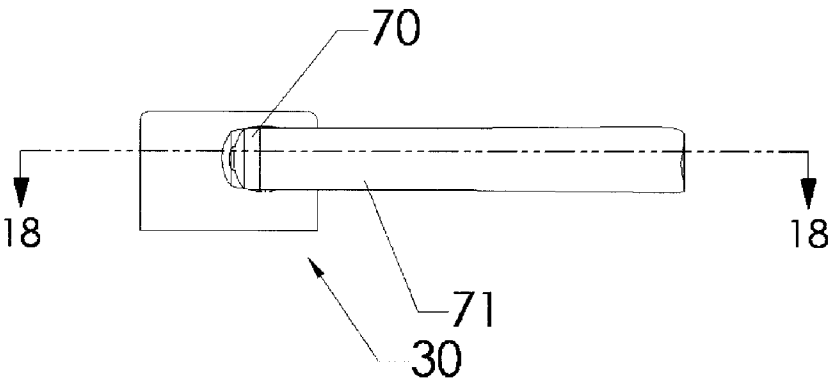
FIG. 17 is a perspective view of the shaper of FIGS. 4-10 being used to shape a side of a cue tip.
Figure 20:
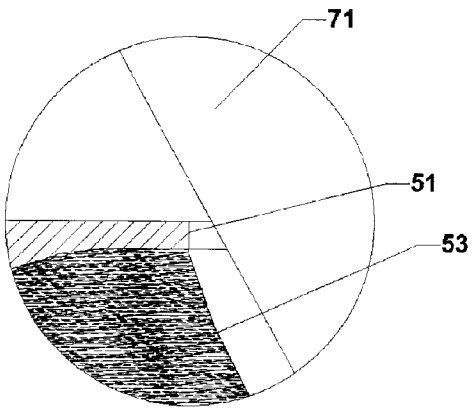
FIGS. 19 and 20 are similar to FIGS. 15 and 16 to illustrate how a ferrule of the cue tip is protected against scuffing while the tip of the cue is shaped.
Figure 19:
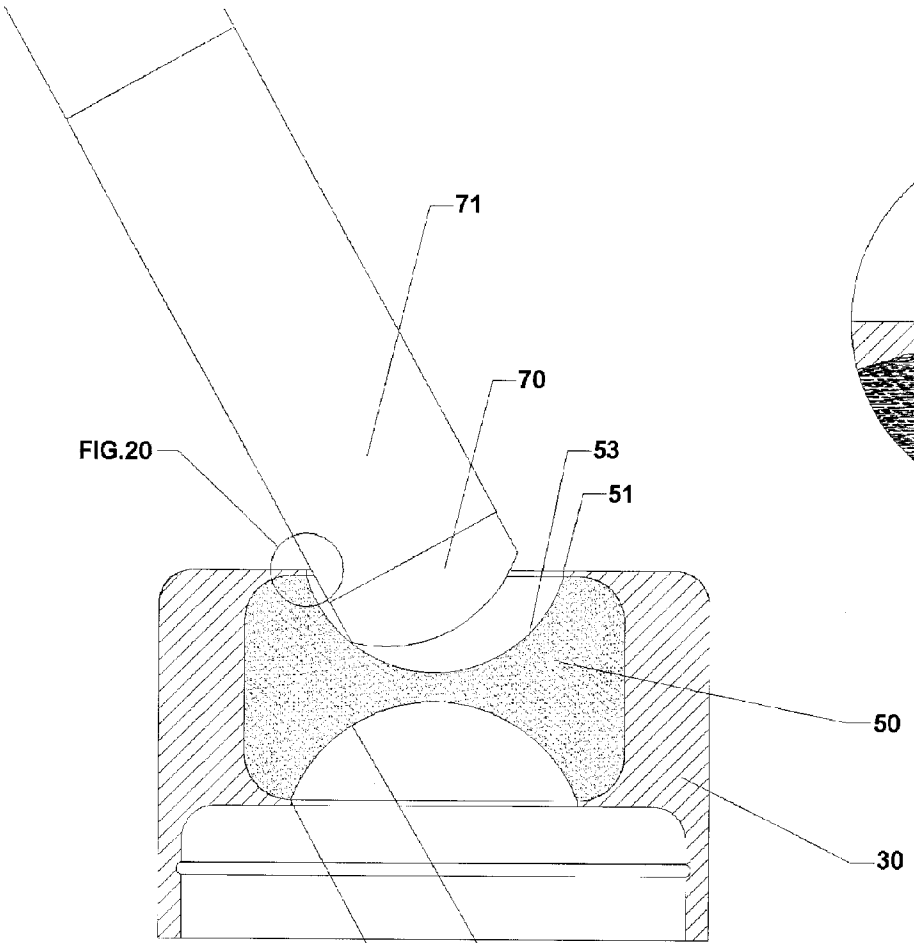

This configuration allows a cue tip to be shaped to whichever radius a user prefers, simply by selecting the proper axial end opening 51 or 52. Such shaping is illustrated in FIGS. 15 and 16, and again in FIGS. 19 and 20, where a cue tip 70 is being worked against the dime radius 53 of the abrasive material 50. The enlarged detail of FIGS. 16 and 20 shows that abrasive material 50 is recessed within opening 51 to prevent any accidental contact of ferrule 71 with abrasive material 50, which could cause unintentional scuffing of ferrule 71. Recessing abrasive material 50 within opening 51 also prevents any accidental abrasion of a surface on which shaper 30 may be placed.

Figure 21:
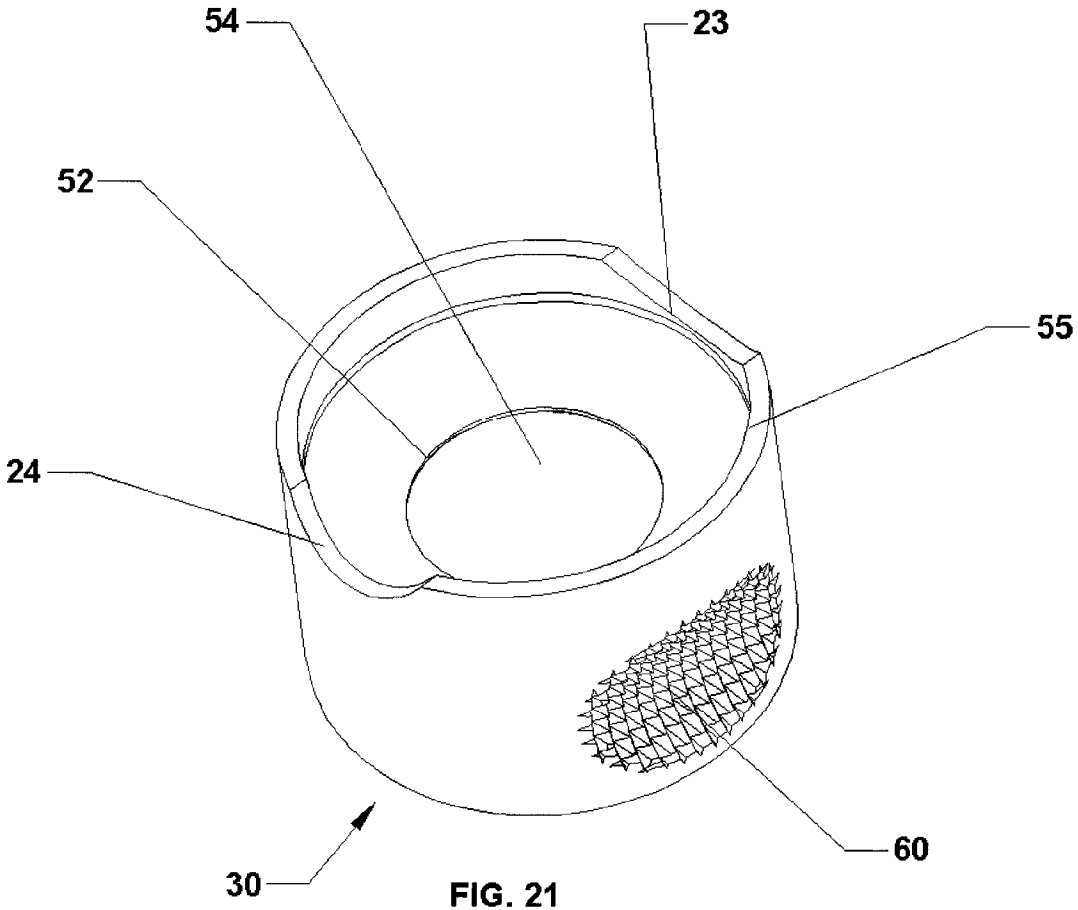
FIG. 21 is an alternative to FIG. 5 showing different placement of tip measuring arcs.

A rim 55 of shaper 30 preferably has a groove 56 that facilitates a snap fit between shaper 30 and holder 20. Rim 55 also affords a convenient place for gauge arcs 23 and 24 to measure the curvature of a cue tip. This arrangement is shown in FIG. 21.

Shaper 30 can also trim and shape a side of cue tip 70 without scuffing ferrule 71. This is done with a specially configured tip guide 40, as illustrated in FIGS. 4, 6,17, and 18. With use, a cue tip tends to mushroom, and this can warrant a side trimming. For this purpose, a guide opening 40, preferably formed in a side of shaper 30, extends toward an opening 41 occupied by abrasive body 50. Guide 40 and the abrasive material in opening 41 can also be arranged somewhere other than in a side of shaper 30.

Guide 40, wherever located, is contoured to engage cue tip 70, and ferrule 71 as tip 70 moves toward engagement with abrasive 50 for trimming a side of cue tip 70. Guide 40 has an entry approach surface 42 aimed to bring tip 70 into contact with abrasive material 50 in opening 41. Before the tip 70 reaches opening 41, the guide has a differently inclined working surface 43, which lifts tip 70 into contact with abrasive material in opening 41. This leaves ferrule 71 engaging entry surface 42 and lifted clear of abrasive material 50 in opening 41. This prevents ferrule 71 from getting scuffed as a side of tip 70 rotates against abrasive 50. Working surface 43 also includes an end stop surface 44 which limits the extent of cue tip 70 and its ferrule 71 into guide 40. These shapes and arrangements allow the side of tip 70 to be trimmed without any danger of scuffing ferrule 71 against abrasive material 50, which is confined within opening 41.

Prior art references such as U.S. Pat. No. 5,104,122 and U.S. Publication No. 2008/0113595 propose abrasive surfaces that can trim a side of a cue tip, but these references do not provide any security against scuffing ferrule 71. They lack the lead in and guide surfaces that can hold ferrule 71 clear of scuffing while a side of tip 70 gets trimmed.

Another operation preferably performed by the inventive tool is indenting a cue tip with tiny holes or cavities that help it retain chalk. A previous suggestion for such an operation occurs in U.S. Pat. No. 5,104,122, which suggests an array of spikes on a flat surface. Since the cue tip 70 is an approximately spherical surface, a flat array of spikes requires tapping or pressing the spike array into the cue tip at different angles and different positions to distribute the holes or cavities irregularly over the cue tip.

The invention proposes accomplishing this with a generally cylindrical and concave recess having a radius approximating the spherical radius of the cue tip. Forming a spike array on a cylindrical concavity is more difficult than forming a spike array on a flat surface, but the cylindrical shape of a spike array works much better in indenting chalk-holding cavities into the cue tip. The cylindrically spiked recess can be formed in any convenient portion of the components included in the inventive tool, but using a side of shaper 30 for this is preferred. A generally cylindrical recess can be formed in a side wall of shaper 30 and then grooved both radially and axially to form a grid of upstanding and pointed spikes. As the radial and axial grooves intersect, they leave pointed spikes formed between the grooves.

As best shown in FIG. 9, the rows of spikes 60, although formed on a cylindrical surface, are all upstandingly oriented to be parallel with a central spike row 61 formed on a radius of the cylindrical concavity. This aims all the spike rows at a cue tip so that the spike rows can be rolled over the curvature of a cue tip to form a regular pattern of indentations across the entire cue tip surface in a single motion. The cue tip contacts the spikes along a line of contact as such rolling occurs so that a moderate force can press each row of spikes into the face of a tip 70, as the spike array is rolled across the cue tip.

Other operations are also preferred for the inventive tool. These also can be arranged on different components. One operation is performed by a burnisher 29 preferably arranged on holder 20, as best shown in FIGS. 11-14. The shaper end 26 of holder 20 has a conical surface 29, preferably formed on a metal insert into the preferably resin body of holder 20, and usable for burnishing a side of a cue tip. When shaper 30 is unsnapped from holder 20, burnishing cone 29 is available for burnishing a trimmed side of a cue tip. This is done simply by pressing the cue tip into the conical surface and rotating the cue or the cone. Another operation is measuring gauges 23 and 24 to determine appropriate curvatures of the cue tip. These can be arranged on shaper 30, holder 20 or elsewhere.

All the above operations are made available within a compact package that includes canister 25 for a chalk block and a talcum powder dispenser. Everything that a wielder of a cue stick requires for trimming, shaping, burnishing, chalking, and stroking a cue stick is available in a package about the size of a cell phone.

What is claimed is:

1. A multi-purpose cue stick tip tool comprising:

a shaper having at least two openings each leading into a central cavity;

abrasive material formed into a predetermined shape within the central cavity;

the abrasive material having a shape that is recessed within the at least two openings to a level below an outer surface of the shaper;

one of the at least two openings having a surface formed as a guide for a cue tip ferrule to rest and rotate against; and the guide surface being shaped to support the ferrule as a side of the cue tip is brought into engagement with the abrasive material to shape the side of the cue tip while the ferrule rotationally engages the guide surface in a region clear of the abrasive to avoid scuffing the ferrule.

2. The tool of claim 1 wherein the guide has a lead in surface approaching the abrasive material and angled from the guide surface so that the lead in surface prevents contact between the ferrule and the abrasive material while allowing contact between the side of the cue tip and the abrasive material.

3. The tool of claim 1 including a cylindrically concave surface having upstanding spikes adapted to be rolled against the cue tip to form indentations.

4. The tool of claim 1 including an end stop surface positioned beyond the guide surface to limit movement of the cue tip beyond the abrasive material.

5. The tool of claim 1 including a conically tapered recess for burnishing a side of a cue tip.

6. The tool of claim 1 wherein the recessing of the abrasive material within the at least two openings prevents the ferrule from engaging the abrasive material.

7. A multi-purpose cue tip tool adapted to shape a cue tip to either of two predetermined spherical radii, and to trim a side surface of a cue tip, the tool comprising:

a shaper having a cavity and three cue tip receiving openings leading into the cavity;

the cavity being filled with abrasive material extending to and recessed within each of the openings where the abrasive material is contoured for shaping or trimming;

the recessing of the abrasive material within the openings being arranged so that surfaces of the openings prevent a ferrule of the cue tip from engaging the recessed abrasive material;

one of the openings and the abrasive material recessed within the one opening being formed to trim a side of the cue tip;

the abrasive material extending into the one opening being arranged relative to a guide surface leading toward the abrasive material so that the guide surface engages and supports a ferrule as it rotates against the guide surface clear of the abrasive material while the tip rotates against the abrasive material for side trimming; and an outer surface of the shaper having a region that is formed to a cylindrically concave contour having an array of upstanding pointed spikes to form indentations in the cue tip.

8. The tool of claim 7 wherein the ferrule guide surface includes an entry surface approaching the abrasive material and a support surface that is angled from the entry surface to allow the ferrule to rotate against the support surface without being scuffed by the abrasive material engaging the cue tip.

9. The tool of claim 7 wherein a portion of the tool is formed with arcs that serve as tip measuring gauges.

10. The tool of claim 7 wherein the shaper is arranged in a package that includes a conically tapered recess for burnishing the side of the cue tip.

11. The tool of claim 7 wherein the upstanding spikes, when rolled against the cue tip, engage the cue tip in a moving line of contact to form indentations in the cue tip.

12. The tool of claim 11 wherein spikes of the concave surface are all oriented parallel with a central row of spikes oriented on a radius of the concave surface.

13. A tool that trims a cylindrical side surface of a cue tip having a spherically curved striking surface, the tool comprising:

a recess having a guide surface, a stop surface, and abrasive material arranged within the recess between the guide surface and the stop surface;

the guide surface being disposed to engage and support a ferrule of the cue tip to guide the cue tip into the recess; and the stop surface being disposed to engage the curved striking surface of the cue tip in a position that brings the side surface of the cue tip rotationally against the abrasive material to trim the side surface while the ferrule engages the guide surface clear of the abrasive material.

14. The tool of claim 13 wherein the guide surface has a lead in surface approaching the abrasive material and an operating surface angled from the lead in surface to avoid contact between the ferrule and the abrasive material while allowing contact between the side of the cue tip and the abrasive material.

15. The tool of claim 14 wherein the end stop surface is smooth.

* * * * *